US011454109B1

(12) United States Patent
Fripp et al.

(10) Patent No.: US 11,454,109 B1
(45) Date of Patent: Sep. 27, 2022

(54) WIRELESS DOWNHOLE POSITIONING SYSTEM

(71) Applicant: Halliburton Energy Services, Inc., Houston, TX (US)

(72) Inventors: Michael Linley Fripp, Carrollton, TX (US); Richard Decena Ornelaz, Frisco, TX (US); Gregory Thomas Werkheiser, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/236,774

(22) Filed: Apr. 21, 2021

(51) Int. Cl.

| | |
|---|---|
| ***E21B 47/095*** | (2012.01) |
| ***E21B 47/18*** | (2012.01) |
| ***E21B 47/16*** | (2006.01) |
| ***E21B 47/07*** | (2012.01) |

(52) U.S. Cl.
CPC ..... *E21B 47/095* (2020.05); *E21B 47/16* (2013.01); *E21B 47/18* (2013.01); *E21B 47/07* (2020.05)

(58) Field of Classification Search
CPC ..... E21B 47/06; E21B 47/07; E21B 47/09; E21B 47/095; E21B 47/12; E21B 47/16; E21B 47/18; E21B 7/26; E21B 7/265; E21B 7/267
See application file for complete search history.

(56) References Cited

U.S. PATENT DOCUMENTS

| | | | | |
|---|---|---|---|---|
| 6,400,646 | B1 | 6/2002 | Shah et al. | |
| 7,104,331 | B2 | 9/2006 | Bussear et al. | |
| 7,424,366 | B2 | 9/2008 | Angelescu et al. | |
| 9,250,112 | B2 * | 2/2016 | Godfrey | G01F 1/667 |
| 9,963,936 | B2 * | 5/2018 | Kruspe | E21B 47/095 |
| 10,132,131 | B2 * | 11/2018 | Vick, Jr. | E21B 47/06 |
| 10,774,619 | B2 * | 9/2020 | Nesgaard | E21B 47/01 |
| 10,794,176 | B2 * | 10/2020 | Miller | E21B 47/24 |
| 11,118,427 | B2 * | 9/2021 | Gupta | E21B 37/00 |
| 2014/0197962 | A1 | 7/2014 | Macpherson | |

(Continued)

FOREIGN PATENT DOCUMENTS

| | | | | |
|---|---|---|---|---|
| WO | WO-2016108906 | A1 * | 7/2016 | E21B 33/12 |

OTHER PUBLICATIONS

PCT Application No. PCT/US2021/028761, International Search Report, dated Jan. 3, 2022, 3 pages.

(Continued)

*Primary Examiner* — Franklin D Balseca
(74) *Attorney, Agent, or Firm* — Delizio, Peacock, Lewin & Guerra

(57) ABSTRACT

Systems and methods for wireless downhole positioning are provided. The method can include synchronizing a first clock with a second clock, wherein the first clock is disposed in a first transmitter, wherein the first transmitter is disposed at a known location, and wherein the second clock is disposed in a downhole tool. The method can further include disposing the downhole tool into a wellbore, wherein the downhole tool comprises a first receiver; transmitting a first wireless signal from the first transmitter along the wellbore at first time; receiving the first wireless signal via the first receiver at a second time; determining a first elapsed time between the first time and the second time; and determining a first downhole position of the downhole tool based on the first elapsed time.

20 Claims, 10 Drawing Sheets

(56) References Cited

U.S. PATENT DOCUMENTS

| | | | |
|---|---|---|---|
| 2015/0300161 | A1 | 10/2015 | Kamata |
| 2018/0010445 | A1 | 1/2018 | Cooper et al. |
| 2019/0376383 | A1 | 12/2019 | Wu et al. |

OTHER PUBLICATIONS

PCT Application No. PCT/US2021/028761, Written Opinion, dated Jan. 3, 2022, 6 pages.

* cited by examiner

WIRELESS DOWNHOLE POSITIONING SYSTEM

TECHNICAL FIELD

The disclosure generally relates to downhole telemetry systems and methods, and particularly to downhole wireless telemetry.

BACKGROUND

In downhole operations where a tool is disposed downhole, for example via a conveyance (e.g., wireline, slickline, coiled tubing, etc.) or without a conveyance (e.g., when pumped or even dropped downhole), it can be useful to have an accurate indication of a downhole location, i.e., a downhole measured depth, of the tool. With a conveyance, lack of tension can lead to inaccurate depth readings. Without a conveyance it can be even more challenging to know the true downhole position of the downhole tool. One solution has been to use casing collar locators, but this at times gives a false depth if a collar is missed. Indeed, a couple of missed collars can lead to a drastically miscalculated depth.

BRIEF DESCRIPTION OF THE DRAWINGS

Embodiments of the disclosure may be better understood by referencing the accompanying drawings.

DESCRIPTION OF EMBODIMENTS

The description that follows includes example systems, methods, techniques, and program flows that embody embodiments of the disclosure. However, it is understood that this disclosure may be practiced without these specific details. For instance, this disclosure refers to various system, methods, and downhole tool configurations in illustrative examples. In other instances, well-known instruction instances, protocols, structures, and techniques have not been shown in detail in order not to obfuscate the description.

Overview

Various systems and methods are described herein for determining a downhole position of a downhole tool using one or more wireless signal. The wireless signal, e.g., an acoustic signal, can be transmitted from to the downhole tool or the downhole tool can transmit the signal. In one or more embodiments, multiple transmitters are used, e.g., in the tool or at another location such as the surface or along the wellbore. In one or more embodiments, multiple receivers are used, e.g., in the tool or at another location such as the surface or along the wellbore. In each case, the downhole tool has clock that is synchronized with another clock at a known location. With synced clocks the timing of a received signal can be used to determine the downhole position of the downhole tool. Understanding the medium of transmission, e.g., whether a fluid or pipe, can be used to refine the downhole position and thereby increase precision. For example, by determining the properties of the fluid in well, the speed of sound can be determined and used to refine the downhole position.

Example Illustrations

Figure 1:
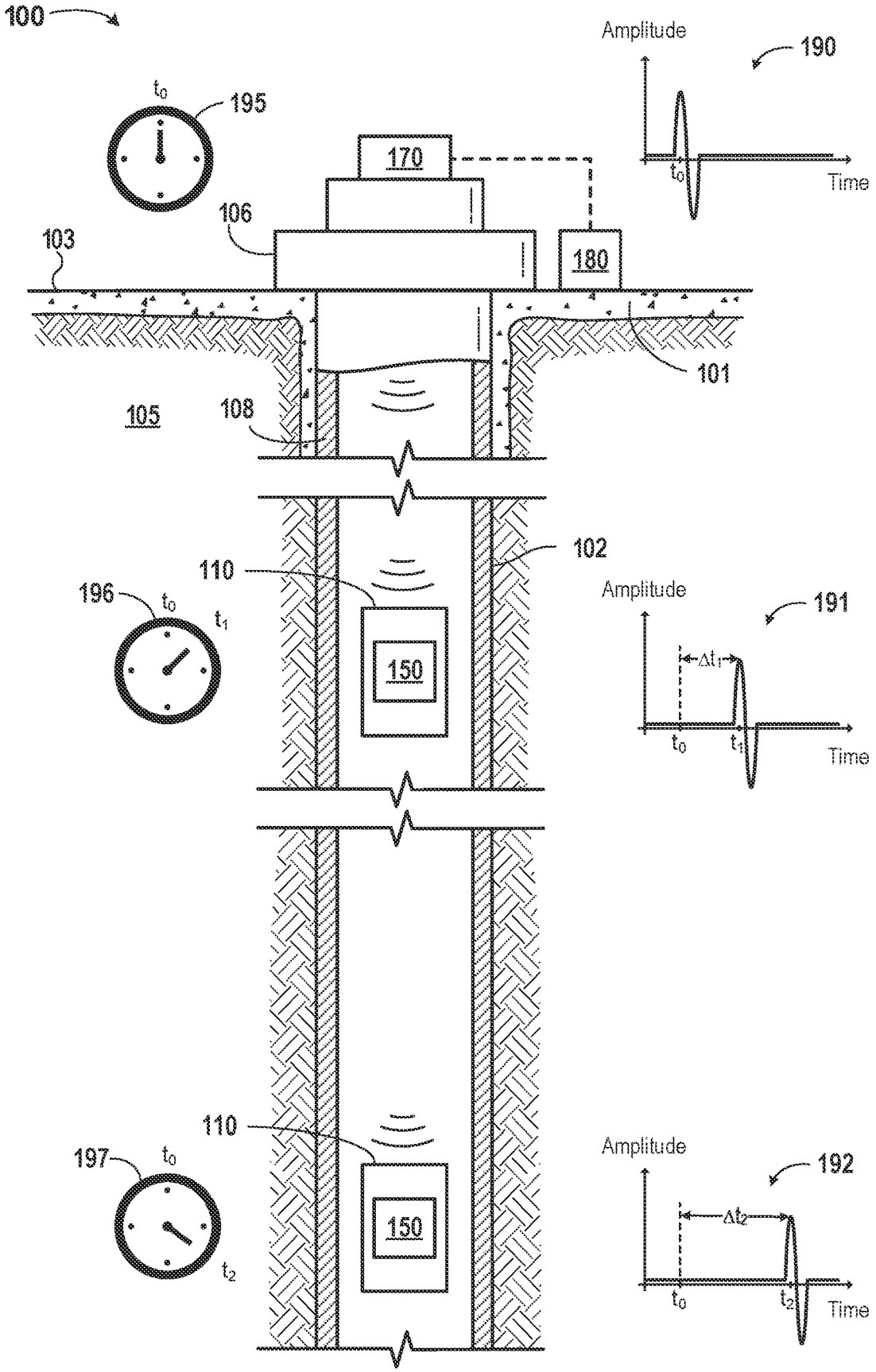
FIG. 1 depicts a partial cross-sectional view of a downhole positioning system, according to one or more embodiments.

FIG. 1 depicts a partial cross-sectional view of a first downhole positioning system 100, according to one or more embodiments. The first downhole positioning system 100 includes a wellbore 102 extending through, i.e., formed in, a subterranean formation 105 from a wellhead 106 located at surface 103 (i.e., the earth's surface). Although not depicted as such, the wellhead 106 could be a subsea wellhead located where the wellbore intersects a sea floor. The wellbore 102 includes a casing 108 (e.g., a casing string). The casing 108 does not necessarily extend the full length of the wellbore 102. The casing 108 can be at least partially cemented into the subterranean formation, e.g., via one or one or more layers of cement 101. Although cement 101 is shown near the surface 103, in one or more embodiments cement can extend the length of the wellbore 102. Although the wellbore 102 is depicted as a single vertical wellbore, other implementations are possible. For example, the wellbore 102 can include one or more deviated or horizontal portions. Although only one casing 108 is shown, multiple casing strings may be radially and/or circumferentially disposed around casing 108. Although not shown here, a tubing or production string can be positioned in the wellbore 102 inside the casing 108, forming an annulus between the tubing string and the casing 108.

The first downhole positioning system 100 further includes a first transceiver 170. In one or more embodiments, the first transceiver 170 can both receive and transmit a wireless signal. In one or more other embodiments, the first transceiver 170 is only a transmitter (i.e., only transmits a wireless signal) or is only a receiver (i.e., only receives a wireless signal). The first transceiver 170 is communicatively coupled to a surface control unit 180. In one or more embodiments, the first transceiver 170 is has a direct electrical connection to the surface control unit 180. In one or more other embodiments, the first transceiver 170 is wirelessly coupled to the surface control unit 180. In one or more embodiments, the first transceiver 170 include a first clock. The first transceiver 170 can be disposed at a known location, e.g., at the surface 103, at the wellhead 106 (as depicted), or in the wellbore 102 at a known depth from the surface 103.

As shown in FIG. 1, the first transceiver 170 can transmit a first wireless signal along the wellbore 102 to a downhole tool 110. The first wireless signal can be transmitted through metal, through, a fluid, or through both metal and a fluid. The first wireless signal can be transmitted via the downhole tubing (e.g., the casing 108, production tubing, or another downhole tubular extending along the wellbore), a fluid disposed in the wellbore 102 (e.g., the wellbore 102 can be at least partially or totally filled with a fluid), or both. In one or more embodiments, the first wireless signal is an acoustic signal transmitted via the first transceiver 170 directly through the fluid in the wellbore, e.g., via an air hammer or gun like a nitrogen hammer. In one or more embodiments, the first wireless signal is a pressure pulse created in the fluid, a ping in the fluid or a tubular, and optionally where the ping is a windowed signal or windowed sinusoid.

In one or more embodiments, the downhole tool 110 includes a receiver 150. In one or more embodiments, the first wireless signal is received by, or via, the downhole tool 110. For example, the first wireless signal can be transmitted through downhole tubing (e.g., casing 108 or other downhole tubular) and through a fluid disposed in the wellbore 102 to be received by the downhole tool 110. The downhole tool 110 can be disposed in the fluid. In another example, the first wireless signal can be transmitted through the fluid in the wellbore 102 and received by the downhole tool 110 through the fluid. In one or more embodiments, the downhole tool 110 is acoustically coupled to the downhole tubing (e.g., having a portion thereof touching the downhole tubing) such that the downhole tool 110 receives the first wireless signal directly via the downhole tubing.

In one or more embodiments, the downhole tool 110 includes a second clock, a machine-readable medium, and a processor. The machine-readable medium can have program code executable by the processor to perform actions or functions, including one or more methods described below. The downhole tool 110 can be a perforating gun, a plug for hydraulic fracturing, an inner tool string, a kickoff guide for multilateral drilling, or another downhole tool. In one or more embodiments, the downhole tool 110 operates without a conveyance. A conveyance can include wireline, slickline, coiled tubing, or the like.

In FIG. 1, the downhole tool 110 is shown at a first downhole position and a second downhole position to depict movement of the downhole tool 110 through the wellbore 102, where the first position is closer to the wellhead 106 (and/or the first transceiver 170) than the second position. FIG. 1 further includes a first graph 190 and a first clock symbol 195 to depict timing of the transmission of the first wireless signal at a first time $t_0$ by the first transceiver 170, a second graph 191 and a second clock symbol 196 to depict timing of the receipt of the first wireless signal at a second time $t_1$ by the receiver 150 of the downhole tool 110, and a third graph 192 and a third clock symbol 197 to depict timing of the receipt of a second wireless signal at a third time $t_2$ by the receiver 150 of the downhole tool 110. In the first graph 190, the second graph 191, and the third graph 192, the X-axis is time, and the Y-axis is amplitude. In the second graph 191, a first elapsed time $\Delta t_1$ is the time between the first time $t_0$ and the second time $t_1$. In the third graph 192, a second elapsed time $\Delta t_2$ is the time between the first time $t_0$ and the third time $t_2$.

Figure 2:
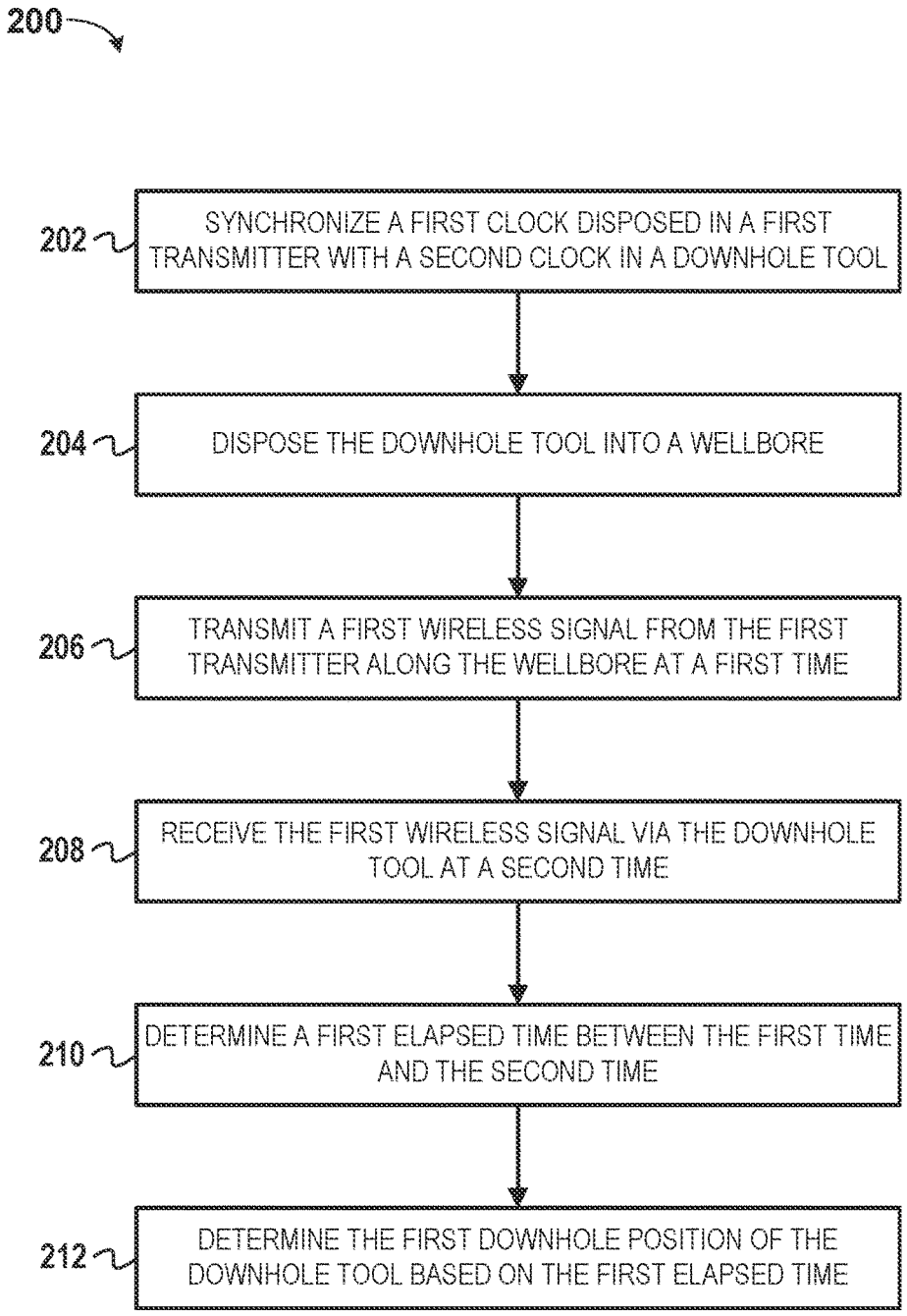
FIG. 2 depicts a flowchart of a first method for determining a downhole position of the downhole tool using the downhole positioning system, according to one or more embodiments.

FIG. 2 depicts a flowchart of a first method 200 for determining a downhole position of the downhole tool 110 using the first downhole positioning system 100, according to one or more embodiments. At step 202, the first clock (disposed in the first transceiver 170) and the second clock (disposed in the downhole tool 110) are synchronized. For example, the first clock and the second clock can be synchronized at a surface location prior to disposing the downhole tool 110 in the wellbore 102. In another example, the first clock and the second clock can be synchronized at a downhole location, e.g., when the first transceiver 170 and downhole tool 110 are in close proximity or via hard wire electrical connection between the first transceiver 170 and the downhole tool 110.

Synchronization of the first clock and the second clock is defined as the connection of at least one of the first clock or the second clock with a common clock. In one or more embodiments, the common clock is provided via a clock signal from a global positioning system (GPS). For example, the first clock can be synchronized with the GPS clock signal and then the second clock can be synchronized with the first clock, as described above. In other embodiments, the common clock can be either the first clock or the second clock. In one or more embodiments, the first clock and the second clock can be synchronized within 100 microseconds (μs). This can provide a 6-inch resolution when the wireless signal is traveling in water which with a sound speed of 5,000 ft per sec (5000 ft/sec×0.000100 sec=0.5 feet). In other embodiments, the first clock and the second clock can be synchronized within 1000 microseconds (μs). This can provide a 60-inch (5 ft) resolution when the wireless signal is traveling through water with a sound speed of 5,000 ft/sec (5000 ft/sec×0.001000 sec=5 ft).

At step 204, the downhole tool 110 is disposed into the wellbore 102. As described above, in one or more embodiments, the wellbore 102 contains one or more fluid, e.g., liquid, air, or a combination thereof. The fluid can be added to the wellbore 102 from the surface, can be produced fluid, or both. In one or more embodiments, the fluid is a known fluid, e.g., because it was placed in the wellbore 102 and/or the chemical makeup of the fluid was determined via a sensor or measurement process. In one or more embodiments, the fluid is a water or a brine. In one or more embodiments, the fluid can include a mix of liquid and air, e.g., a foam. The downhole tool 110 can be disposed in the fluid, and lowered to a first downhole position, i.e., a first location in the wellbore. (Prior to completion of the first method 200, this first downhole position may not be known with much certainty.) In one or more embodiments, the downhole tool 110 is pumped into and/or with the fluid and along the wellbore 102 to the first downhole position. For example, one or more pumps can be employed at the surface 103 or at the wellhead 106 to force the downhole tool 110 down into and along the wellbore via pumping of the fluid. In one or more embodiments, the downhole tool 110 is not tethered to the surface by any conveyance (e.g., tubular, wireline, slickline, coiled tubing, or the like).

At step 206, a first wireless signal is transmitted from the first transceiver 170 along the wellbore 102 at the first time $t_0$, as depicted in the first graph 190 in FIG. 1 and the first clock symbol 195. As discussed above, the first wireless signal can be transmitted through the fluid, through downhole tubing disposed in the wellbore (e.g., casing 108, production tubing, or another type of downhole tubular), or both.

At step 208, the first wireless signal is received via the downhole tool 110 at the second time $t_1$, as depicted in the second graph 191 in FIG. 1 and the second clock symbol 196. The downhole tool 110 can receive the first wireless signal via the receiver 150. The time of receipt of the first wireless signal, i.e., second time $t_1$, can be recorded by the downhole tool 110.

At step 210, the first elapsed time $\Delta t_1$ between the first time $t_0$ and the second time $t_1$ is determined. In one or more embodiments, the machine-readable medium in the downhole tool 110 can have program code executable by the processor to determine the first elapsed time $\Delta t_1$ based on the first time $t_0$ and the second time $t_1$. Because the first clock and the second clock are synchronized, difference between the second time $t_1$ and first time $t_0$ can be determined. In one or more embodiments, the transmission of the first wireless signal only occurs at a set time. For example, the transmission from the surface can occur every minute, every 30 seconds, every second, or every millisecond, or some other regular interval. In this example, the downhole tool 110 can determine the first elapsed time $\Delta t_1$ by subtracting the second time $t_1$ from the set time, i.e., assigning the set time as the first time $t_0$. The regular interval from the set time can be determined based on the anticipated maximum transmission time based on the length of the wellbore 102, the transmission medium, the temperature profile of the wellbore, and/or the pressure profile of the wellbore.

At step 212, the first downhole position of the downhole tool 110 is determined based on the first elapsed time $\Delta t_1$. The relationship between the first downhole position, i.e., the measured depth of the tool along the wellbore, and the elapsed time $\Delta t_1$ is determined based on the speed of sound in the transmission medium (e.g., the fluid, downhole tubing, or both through which the wireless signal passes) and attenuation. If the transmission medium is the downhole tubing, e.g., steel, the speed of the first wireless signal is nearly constant, but the transmission distance may be limited due to attenuation of the signal. Systems that rely wholly on acoustic transmission through the tubular will often employ repeaters due to the attenuation. As such, when one or more repeaters are utilized between the first transceiver 170 and the receiver 150, repeater delay can also be accounted for in the determination of the first downhole position based on the elapsed time $\Delta t_1$. Alternatively, the downhole tool 110 can calculate its position relative to at least one of the one or more repeaters.

If the transmission medium is the fluid, then the speed of sound will vary with the temperature and hydrostatic pressure of the fluid. By knowing the fluid, either because it was purposely introduced into the wellbore 102 or by determining the fluid composition, the speed of sound can be estimated based on the temperature and pressure of the fluid in the wellbore 102.

Figure 3:
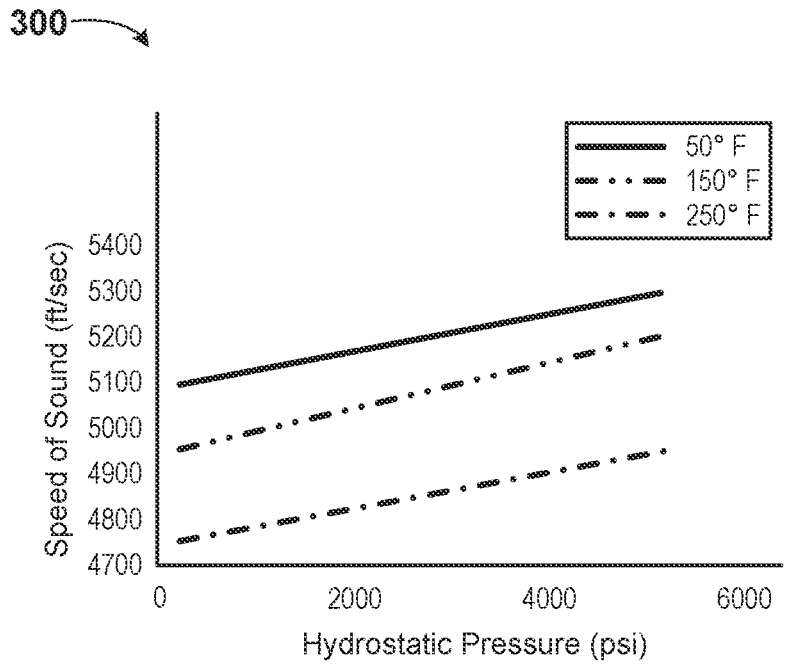
FIG. 3 depicts a graph showing the relationship between the speed of sound in water, hydrostatic pressure, and temperature, according to one or more embodiments.

FIG. 3 depicts a graph 300 showing the relationship between the speed of sound in water, hydrostatic pressure, and temperature, according to one or more embodiments. The Y-axis of the graph 300 depicts the speed of sound in ft/second, the X-axis depicts the hydrostatic pressure in pounds per square inch (psi). Three curves are shown for 3 different temperatures in Fahrenheit (F), 50° F., 150° F., and 250° F. As shown the speed of sound increases with pressure when the temperature is held constant. Graph 300 also depicts the importance of knowing the temperature, given the speed of sound can vary over temperature in a non-linear manner.

The downhole tool 110 can include a pressure sensor, a temperature sensor, or both, e.g., the pressure sensor and/or temperature sensor can be disposed in the downhole tool 110. In one or more embodiments, the pressure sensor can measure a pressure in the wellbore 102 with the pressure sensor to provide a measured pressure. In one or more embodiments, the temperature sensor can measure a temperature in the wellbore 102 with the temperature sensor to provide a measured temperature. The estimated speed of sound can be based on at least one of the measured pressure or the measured temperature. In one or more embodiments, only the pressure is measured or only the temperature is measured. For example, the temperature can be assumed based on the fluid and previous measurements (e.g., measurements from external sources or measurements of nearby wells) and the pressure can be measured by the pressure sensor in the tool. In another example, the pressure can be assumed based on the fluid and previous measurements and the temperature can be measured by the temperature sensor.

In one or more embodiments, the pressure in the wellbore 102 can be determined based on a pressure profile along the wellbore (e.g., previously measured or assumed based on external data) to provide a determined pressure. In one or more embodiments, the temperature in the wellbore 102 can be determined based on a temperature profile along the wellbore (e.g., previously measured or assumed based on external data) to provide a determined temperature. The estimated sound can be based on at least one of the determined pressure or the determined temperature. In one or more embodiments, the pressure profile is assumed to be linear along the wellbore that accounts for hydrostatic pressure and frictional pressure drops. In one or more embodiments, the temperature profile is assumed to be linear along the wellbore. In one or more embodiments, either the temperature along the wellbore, the pressure along the wellbore, or both can be determined via one or more numerical models. During pumpdown of the downhole tool 110, temperature variation along the wellbore 102 can be minimized because the fluid being pumped into the wellbore 102 can cool the wellbore 102.

The first method 200 can be repeated as the downhole tool 110 moves along the wellbore 102. In FIG. 1, the downhole tool 110 is also shown in second downhole position, i.e., by showing the downhole tool 110 further along the wellbore 102, i.e., at a lower measured depth. With the downhole tool 110 moved to a new position (i.e., the second downhole position) a second wireless signal can be transmitted from the first transceiver 170 along the wellbore 102 at the first time $t_0$, though this "first time" is a new "first time", i.e., it is a different time than the time used to transmit the signal when the tool was at the first downhole position. However, this "first time" can be a set time according to the programing of both the downhole tool 110 and the first transceiver 170, and for purposes of illustration is treated as the first time $t_0$ to show the difference of elapsed time between receipt when the downhole tool 110 is at the first downhole position from that of when the downhole tool 110 is at the second downhole position.

The second wireless signal is received via the downhole tool 110 (i.e., via the receiver 150) at the third time $t_2$. As mentioned above, the third graph 192 and the third clock symbol 197 depict timing of the receipt of the second wireless signal at the third time $t_2$ by the receiver 150 of the downhole tool 110, where receipt at the third time $t_2$ by the receiver 150 is due to the downhole tool being located at the second downhole position.

The second elapsed time $\Delta t_2$ is then determined. As depicted in the third graph 192, the second elapsed time $\Delta t_2$ is the time between the first time $t_0$ and the third time $t_2$. In one or more embodiments, the machine-readable medium in the downhole tool 110 can have program code executable by the processor to determine the second elapsed time $\Delta t_1$ based on the first time $t_0$ and the third time $t_2$. Because the first clock and the second clock are synchronized, difference between the third time $t_2$ and first time $t_0$ can be determined. In one or more embodiments, the transmission of the second wireless signal only occurs at a set time or set time interval, e.g., the at the same interval as the first wireless signal. For example, the transmission from the surface can occur every minute, every 30 seconds, every second, or every millisecond, or some other regular interval. In this example, the downhole tool 110 can determine the second elapsed time $\Delta t_2$ by subtracting the third time $t_2$ from the set time, i.e., assigning the set time as the first time $t_0$. As depicted, the second elapsed time $\Delta t_2$ is longer than the first elapsed time $\Delta t_1$ due to the downhole tool 110 having moved to the second downhole position, i.e., having moved further from the first transceiver 170. Based on the second elapsed time $\Delta t_2$, the second downhole position is determined, e.g., taking into account the speed of sound in the transmission medium, attenuation, etc. as described above.

Figure 4:
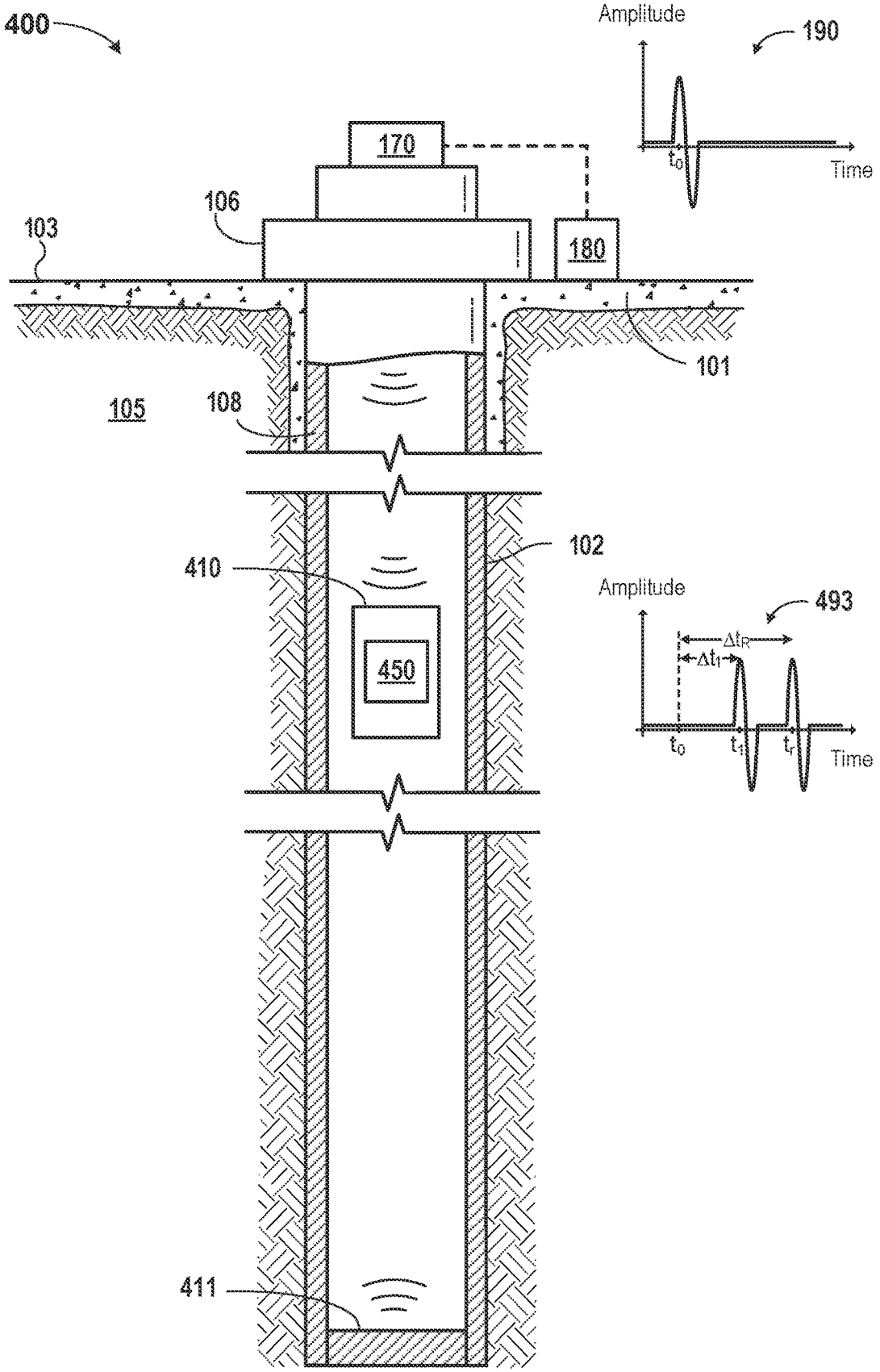
FIG. 4 depicts a partial cross-sectional view of a second downhole position system that utilizes a reflected pulse to refine the downhole position of a downhole tool, according to one or more embodiments.

FIG. 4 depicts a partial cross-sectional view of a second downhole position system 400 that utilizes a reflected pulse to refine the downhole position of a second downhole tool 410, according to one or more embodiments. In the second downhole position system 400, the downhole tool 410 has the capability to receive a reflected or secondary signal via a receiver 450. As with the first downhole positioning system 100, the first transceiver 170 transmits the first wireless signal at a first time $t_0$ and receives the first wireless signal via the receiver 450 at a second time. Similarly, the first elapsed time $\Delta t_1$ can be determined based on the difference between the first time $t_0$ and the second time $t_1$, and the first downhole position can be determined based on the first elapsed time $\Delta t_1$.

In addition to receiving the first wireless signal at the first time $t_1$, the receiver 450 receives the secondary signal at a third time $t_r$, as depicted by a graph 493. The secondary signal can be a reflection of the first wireless signal off the wellbore bottom 411 (as depicted), off of a downhole tubular (e.g., a lower completion), or off another downhole object (e.g., a packer, sleeve, shoe, another downhole tool, or the like). For example, when the first wireless signal is transmitted in a fluid, e.g., water or a brine, the first wireless signal often can reflect off of the wellbore bottom 411. A second elapsed time $\Delta t_R$ can be determined based on the difference between the first time to and the third time $t_r$. As long as the downhole position, i.e., measured depth, of the object that provides the source of the secondary signal is known, e.g., the wellbore bottom 411 can be at known measured depth, the first downhole position can be refined or updated based on the second elapsed time $\Delta t_R$.

Figure 5:
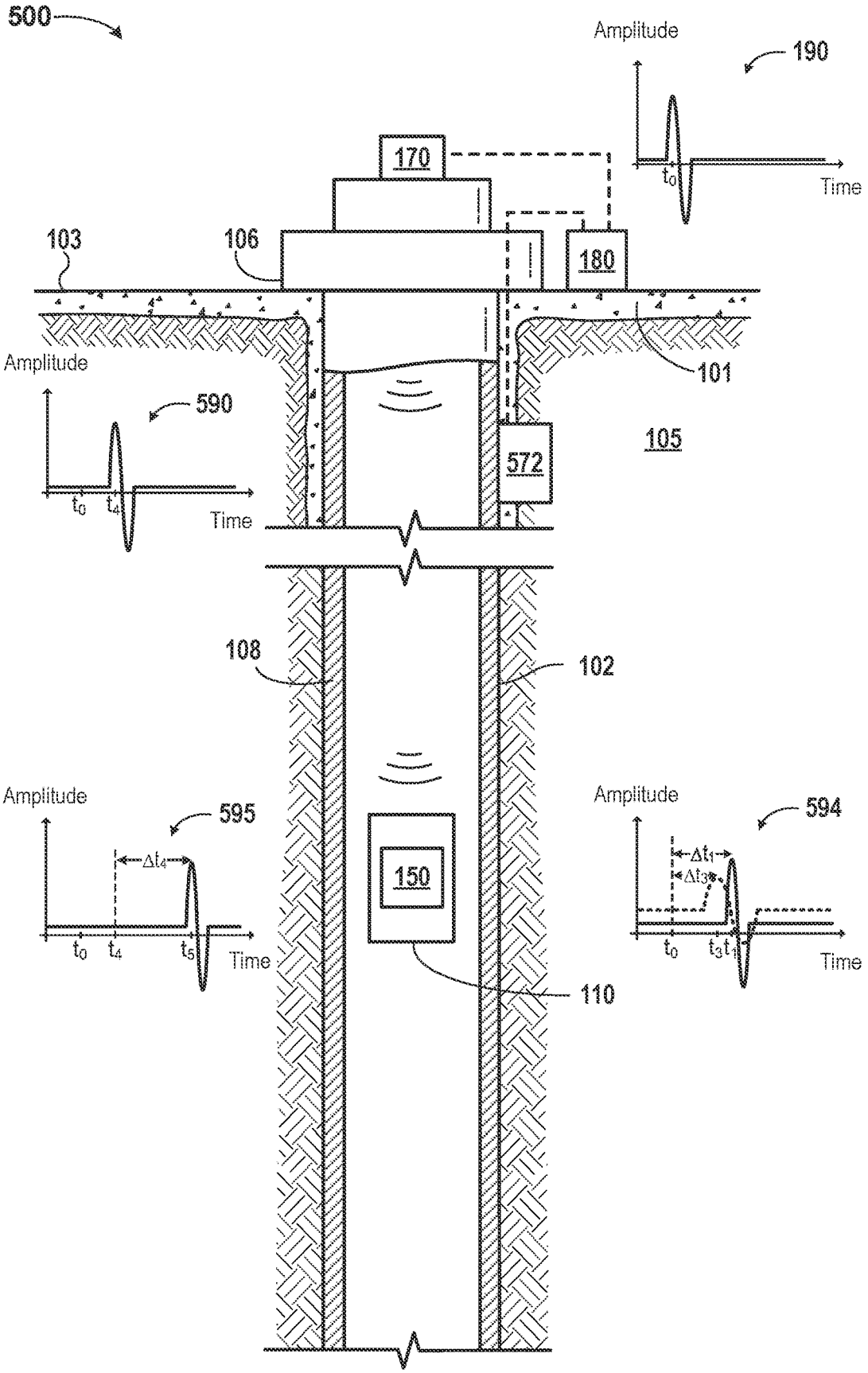
FIG. 5 depicts a partial cross-sectional view of a third downhole positioning system, according to one or more embodiments.

FIG. 5 depicts a partial cross-sectional view of a third downhole positioning system 500, according to one or more embodiments. The third downhole position system 500 includes one or more transceivers to transmit one or more wireless signals. As depicted, the third downhole position system 500 includes two such transceivers, the first transceiver 170 and a second transceiver 572. The second transceiver 572 is disposed at a known location. For example, the second transceiver 572 can be disposed at surface, at the wellhead 106, or along the wellbore 102 (e.g., coupled to the casing 108 as shown or to a tubing string disposed within the casing 108) at a known distance from the surface, i.e., a known depth. In one or more embodiments, the second transceiver 572 is located along the wellbore 102 at a fixed distance from the first transceiver 170. In one or more embodiments, the second transceiver 572 can both receive and transmit a wireless signal. In one or more other embodiments, the second transceiver 572 is only a transmitter (i.e., only transmits a wireless signal) or is only a receiver (i.e., only receives a wireless signal).

With the downhole tool 110 still at the first position, the second transceiver 572 can act as a second transmitter and can transmit a second wireless signal along the wellbore 102. In one or more embodiments, second transceiver 572 transmits the second wireless signal along the wellbore 102 at the first time $t_0$, and the receiver 150 in the downhole tool 110 can receive the second wireless signal at a fourth time $t_3$ as shown in graph 594. For example, both the first transceiver 170 and the second transceiver 572 can transmit their respective signals at the same time, but the second wireless signal can have a different frequency than the first wireless signal. The downhole tool 110, e.g., via program instructions executed by processor, can determine a third elapsed time $\Delta t_3$ based on a difference between the first time $t_0$ and the fourth time $t_3$. Based on the third elapsed time $\Delta t_3$ the downhole tool 110, e.g., via the processor, can refine the first downhole position.

In one or more embodiments, the second transceiver 572 transmits the second wireless signal along the wellbore 102 at a fifth time $t_4$ as depicted by graph 590 (i.e., transmitting at a different time from transmission of the first wireless signal from the first transceiver 170), and the receiver 150 in the downhole tool 110 can receive the second wireless signal at a sixth time $t_5$ as depicted by graph 595. The downhole tool 110, e.g., via program instructions executed by processor, can determine a fourth elapsed time $\Delta t_4$ based on a difference between the sixth time $t_5$ and the fifth time $t_4$. Based on the fourth elapsed time $\Delta t_4$ the downhole tool 110, e.g., via the processor, can refine the first downhole position.

In one or more embodiments, additional transceivers can be added along the wellbore or at the surface, each of which can operate in one of the manners described above to provide different elapsed times that can be used to refine the first downhole position. For example, one or more additional transceiver (such as one or more repeater for an acoustic telemetry system) disposed at a known distance from the surface can be used to transmit a signal to the downhole tool. The elapsed time between transmission and receipt of the signal by the downhole tool 110 can be used to further refine the first downhole position of the downhole tool 110 or to further refine the speed of sound of the wireless signal.

Figure 6:
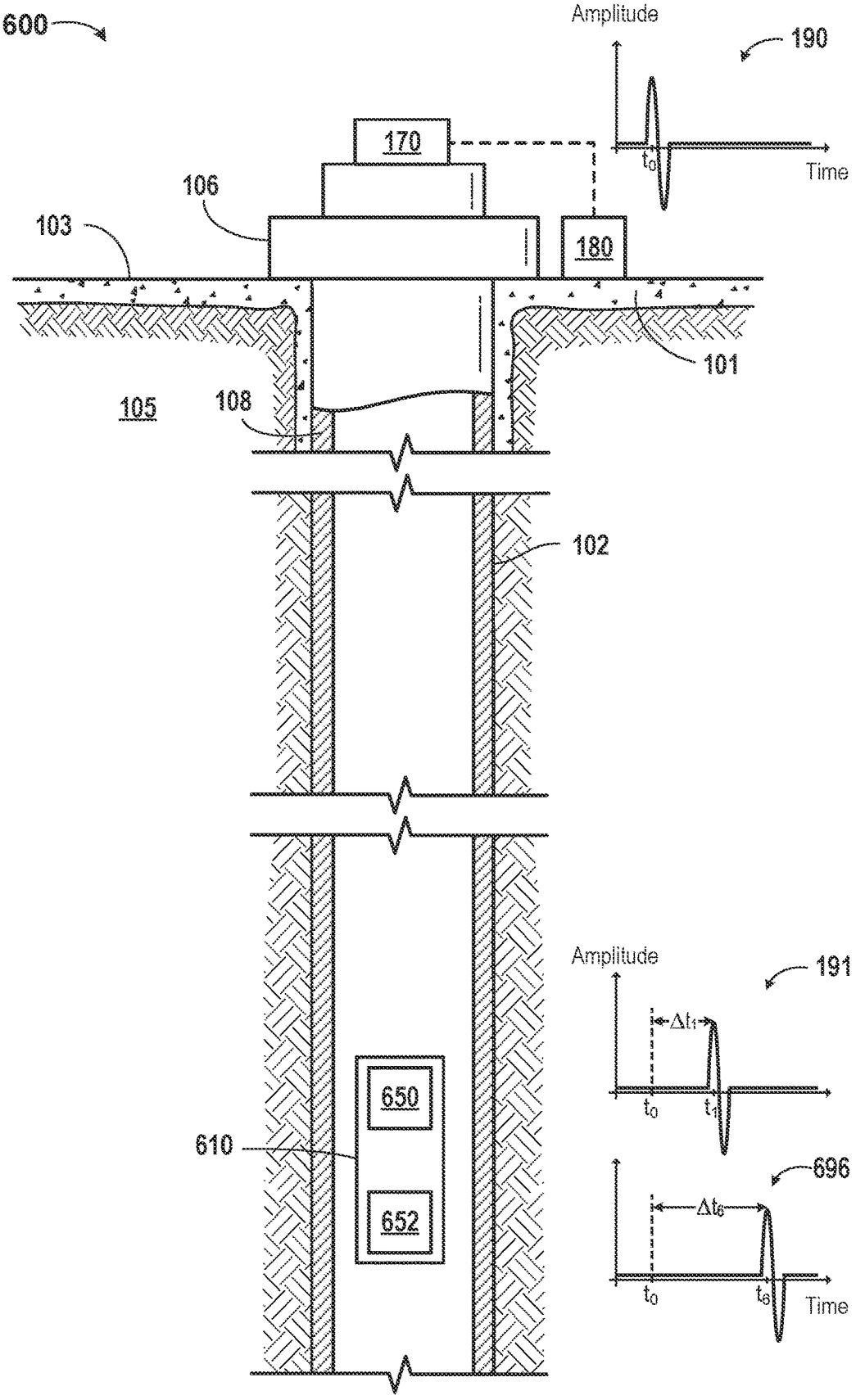
FIG. 6 depicts a partial cross-sectional view of a fourth downhole positioning system having a second downhole tool having two or more receivers, according to one or more embodiments.

FIG. 6 depicts a partial cross-sectional view of a fourth downhole positioning system 600 having a third downhole tool 610 having two or more receivers, according to one or more embodiments. As depicted, the third downhole tool 610 has at least a first receiver 650 and a second receiver 652. In one or more embodiments, the first receiver 650 is disposed in an upper portion of the third downhole tool 610 (e.g., a portion of the third downhole tool 610 that is closer to the wellhead 106) and the second receiver 652 is disposed in a lower portion of the third downhole tool 610, i.e., the second receiver 652 is disposed farther from a transmitter (e.g., the first transceiver 170) than the first receiver 650.

In the operation of the third downhole tool 610, a first wireless signal is transmitted from the first transceiver 170 along the wellbore 102 at the first time $t_0$ (as described in step 206). Similar to what is described in step 208 above, the first wireless signal is received at a second time $t_1$ via the first receiver 650. The first wireless signal is also receiver at seventh time $t_6$ via the second receiver 652 as depicted by graph 696. In one or more embodiments, a sixth elapsed time $\Delta t_6$ can be determined based on a difference between the seventh time $t_6$ and the first time $t_0$. A time delay between the second time $t_1$ and the seventh time $t_6$ can be determined, the speed of sound can be estimated and/or refined based on the time delay, and the first downhole position can be refined. In one or more embodiments, the first elapsed time $\Delta t_1$ and the sixth elapsed time $\Delta t_6$ can be compared and/or used to estimate or refine the speed of sound and then refine the first downhole position.

Figure 7:
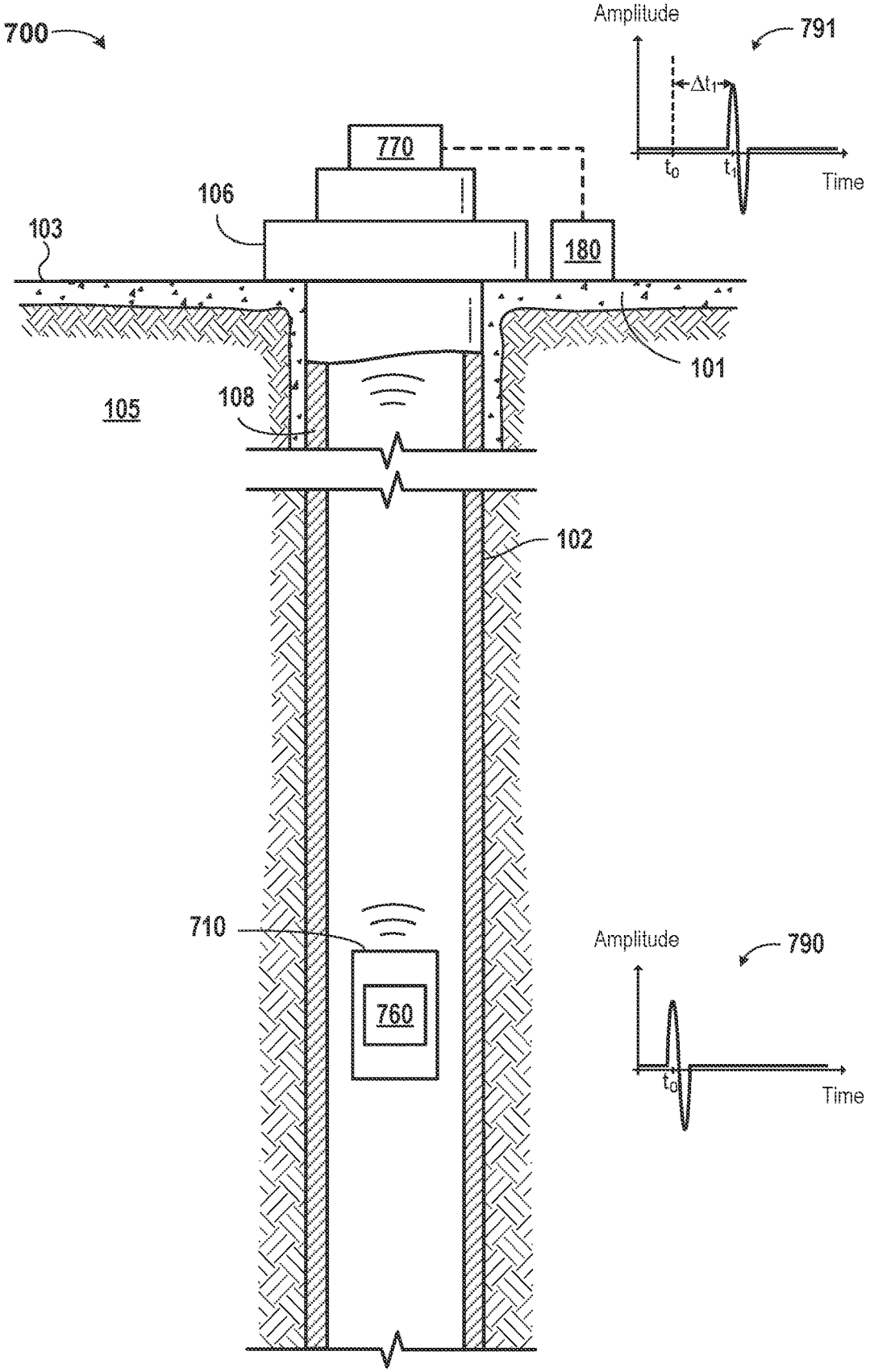
FIG. 7 depicts a partial cross-sectional view of a fifth downhole positioning system, according to one or more embodiments.

FIG. 7 depicts a partial cross-sectional view of a fifth downhole positioning system 700, according to one or more embodiments. The fifth downhole positioning system 700 includes the wellbore 102 extending through the subterranean formation 105 from the wellhead 106 and including the casing 108. As with the other embodiments described, although only one casing 108 is shown, multiple casing strings may be radially and/or circumferentially disposed around casing 108. Also, although not shown, a tubing or production string can be positioned in the wellbore 102 inside the casing 108, forming an annulus between the tubing string and the casing 108.

The fifth downhole positioning system 700 includes a third receiver 770. The third receiver 770 is communicatively coupled to a surface control unit 180, e.g., via a direct electrical connection, fiber optic connection, or a wireless connection. In one or more embodiments, the third receiver 770 includes a first clock. The third receiver 770 can be disposed at a known location, e.g., at the surface 103, at the wellhead 106 (as depicted), or in the wellbore 102 at a known depth from the surface 103, e.g., coupled to the casing 108 or another downhole tubular.

In one or more embodiments, the fourth downhole tool 710 includes a first transmitter 760. The first transmitter 760 can transmit a first wireless signal along the wellbore 102 to the third receiver 770. The first wireless signal can be an acoustic signal or a pressure signal. The first wireless signal can be transmitted via the downhole tubing (e.g., the casing 108, production tubing, or another downhole tubular extending along the wellbore), a fluid disposed in the wellbore 102, or both. In one or more embodiments, the first wireless signal is an acoustic signal transmitted via the first transmitter 760 directly through the fluid in the wellbore, e.g., via an air hammer or gun like a nitrogen hammer. In one or more embodiments, the first wireless signal is a pressure pulse created in the fluid, a ping in the fluid or a tubular, and optionally where the ping is a windowed signal or windowed sinusoid.

In one or more embodiments, the first wireless signal is received by, or via, the third receiver 770. For example, the first wireless signal can be transmitted through downhole tubing (e.g., casing 108 or other downhole tubular) and/or through a fluid disposed in the wellbore 102 to be received by the third receiver 770. The fourth downhole tool 710 can be disposed in the fluid. In another example, the first wireless signal can be transmitted through the fluid in the wellbore 102 and received by the third receiver 770 through the fluid. In one or more embodiments, the fourth downhole tool 710 is acoustically coupled to the downhole tubing (e.g., having a portion thereof touching the downhole tubing) such that the fourth downhole tool 710 transmits the first wireless signal directly via the downhole tubing to the third receiver 770.

In one or more embodiments, the fourth downhole tool 710 includes a second clock. The surface control unit 180 can include a machine-readable medium and a processor. The machine-readable medium can have program code executable by the processor to perform actions or functions, including one or more methods described below.

The fourth downhole tool 710 is shown at a first downhole position. FIG. 7 further includes a first graph 790 to depict timing of the transmission of the first wireless signal at a first time $t_0$ by the first transmitter 760 and a second graph 791 to depict timing of the receipt of the first wireless signal at a second time $t_1$ by the third receiver 770. In the second graph 791, a first elapsed time $\Delta t_1$ is the time between the first time $t_0$ and the second time $t_1$. A first downhole position of the fourth downhole tool 710 can be determined based on the first elapsed time $\Delta t_1$.

Figure 8:
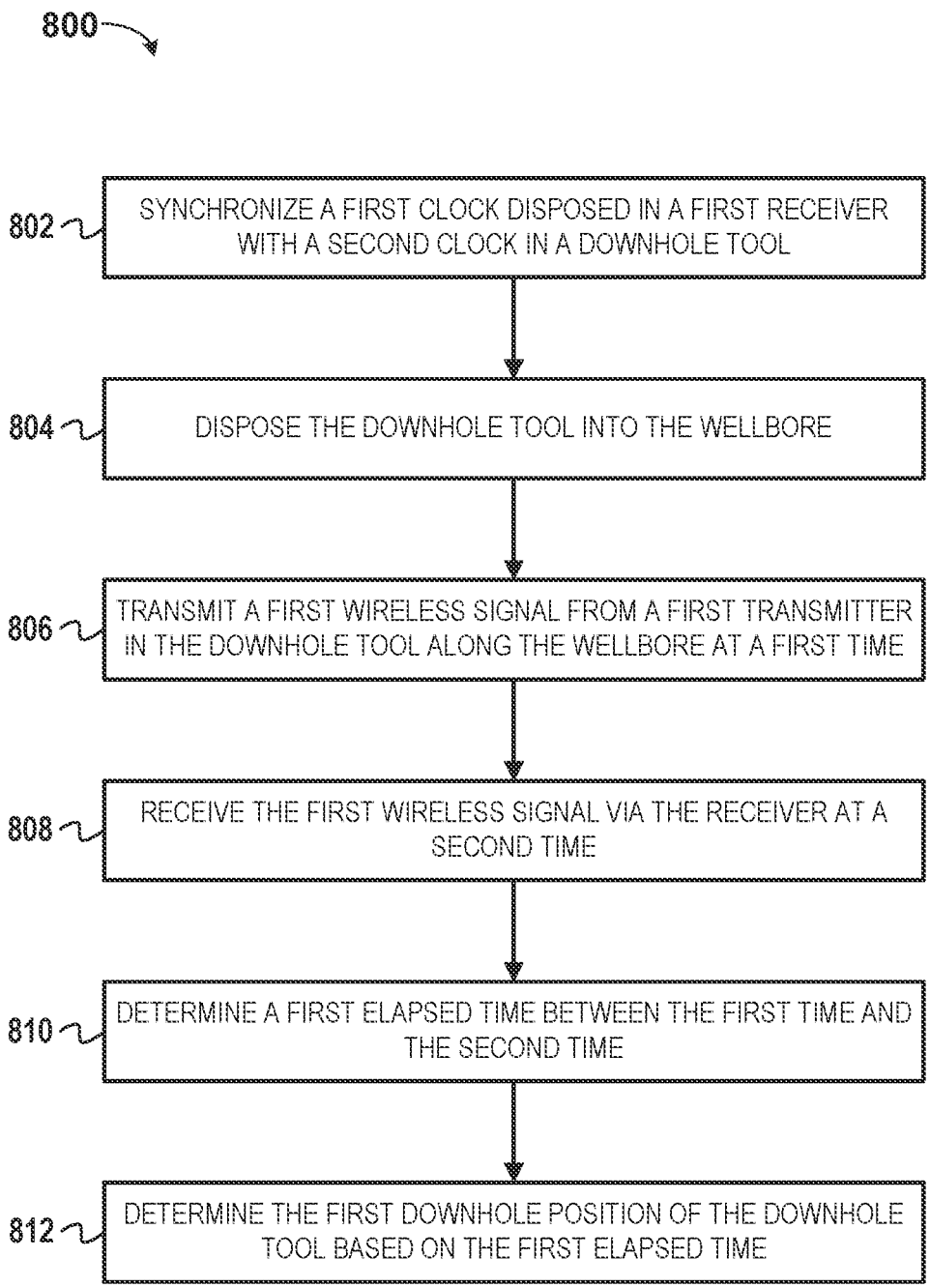
FIG. 8 depicts a flowchart of a second method for determining a downhole position of the third downhole tool using the fifth downhole positioning system, according to one or more embodiments.

FIG. 8 depicts a flowchart of a second method 800 for determining a downhole position of the fourth downhole tool 710 using the fifth downhole positioning system 700, according to one or more embodiments. At step 802, the first clock (disposed in the third receiver 770) and the second clock (disposed in the fourth downhole tool 710) are synchronized. For example, the first clock and the second clock can be synchronized at a surface location prior to disposing the fourth downhole tool 710 in the wellbore 102. In another example, the first clock and the second clock can be synchronized at a downhole location, e.g., when the third receiver 770 and fourth downhole tool 710 are in close proximity or via hard wire electrical connection between the third receiver 770 and the fourth downhole tool 710. Synchronization of the first clock and the second clock can be as described above with respect to FIGS. 1-2.

At step 804, the fourth downhole tool 710 is disposed into the wellbore 102. As described above, in one or more embodiments, the wellbore 102 contains one or more fluid, e.g., liquid, air, or a combination thereof. The fluid can be added to the wellbore 102 from the surface, can be produced fluid, or both. In one or more embodiments, the fluid is a known fluid, e.g., because it was placed in the wellbore 102 and/or the chemical makeup of the fluid was determined via a sensor or measurement process. In one or more embodiments, the fluid is a water or a brine. In one or more embodiments, the fluid can include a mix of liquid and air, e.g., a foam. The fourth downhole tool 710 can be disposed in the fluid, and lowered to a first downhole position, i.e., a first location in the wellbore. (Prior to completion of the second method 800, this first downhole position may not be known with much certainty.) In one or more embodiments, the fourth downhole tool 710 is pumped into and/or with the fluid and along the wellbore 102 to the first downhole position. For example, one or more pumps can be employed at the surface 103 or at the wellhead 106 to force the fourth downhole tool 710 down into and along the wellbore via pumping of the fluid. In one or more embodiments, the fourth downhole tool 710 is not tethered to the surface by any conveyance (e.g., tubular, wireline, slickline, coiled tubing, or the like).

At step 806, a first wireless signal is transmitted from the first transmitter 760 along the wellbore 102 at the first time $t_0$, as depicted in the first graph 790 in FIG. 7. As discussed above, the first wireless signal can be transmitted through the fluid, through downhole tubing disposed in the wellbore (e.g., casing 108, production tubing, or another type of downhole tubular), or both. At step 808, the first wireless signal is received via the third receiver 770 at the second time $t_1$, as depicted in the second graph 791 in FIG. 7. The time of receipt of the first wireless signal, i.e., second time $t_1$, can be recorded by the third receiver 770 and/or the connected surface control unit 180.

At step 810, the first elapsed time $\Delta t_1$ between the first time $t_0$ and the second time $t_1$ is determined. In one or more embodiments, the machine-readable medium in surface control unit 180 can have program code executable by the processor to determine the first elapsed time $\Delta t_1$ based on the first time $t_0$ and the second time $t_1$. Because the first clock and the second clock are synchronized, difference between the second time $t_1$ and first time $t_0$ can be determined. In one or more embodiments, the transmission of the first wireless signal only occurs at a set time. For example, the transmission from the surface can occur every minute, every 30 seconds, every second, or every millisecond, or some other regular interval. In this example, the surface control unit 180 can determine the first elapsed time $\Delta t_1$ by subtracting the second time $t_1$ from the set time, i.e., assigning the set time as the first time $t_1$. The regular interval from the set time can be determined based on the anticipated maximum transmission time based on the length of the wellbore 102, the transmission medium, the temperature profile of the wellbore, and/or the pressure profile of the wellbore.

At step 812, the first downhole position of the fourth downhole tool 710 is determined based on the first elapsed time $\Delta t_1$. As described above, the relationship between the first downhole position, i.e., the measured depth of the tool along the wellbore, and the elapsed time $\Delta t_1$ is determined based on the speed of sound in the transmission medium (e.g., the fluid, downhole tubing, or both through which the wireless signal passes) and attenuation. If the transmission medium is the downhole tubing, e.g., steel, the speed of the first wireless signal is nearly constant, but the transmission distance may be limited due to attenuation of the signal. Systems that rely wholly on acoustic transmission through the tubular will often employ repeaters due to the attenuation. As such, when one or more repeaters are utilized between the third receiver 770 and the first transmitter 760, repeater delay can also be accounted for in the determination of the first downhole position based on the elapsed time $\Delta t_1$. If the transmission medium is the fluid, then the speed of sound will vary with the temperature and pressure of the fluid. By knowing the fluid, the speed of sound can be estimated based on the temperature and pressure of the wellbore, as described above.

The second method 800 can be repeated as the fourth downhole tool 710 moves along the wellbore 102. For example, as the fourth downhole tool 710 moves to a second downhole position, the first transmitter 760 can transmit a second wireless signal through the wellbore 102 to the third receiver 770. Based on the timing of the receipt of the second wireless signal, the elapsed time between transmission of the second wireless signal and receipt thereof can be determined and then used to determine the second downhole position. Pressure and/or temperature determinations, as described above, can likewise be used to determine the speed of sound, and refine the first downhole position or second downhole position.

FIGS. 2 & 8 are annotated with a series of numbers. These numbers can represent stages of operations. Although these stages are ordered for this example, the stages illustrate one example to aid in understanding this disclosure and should not be used to limit the claims. Subject matter falling within the scope of the claims can vary with respect to the order and some of the operations. For example, other operations can be performed before the determination of the elapsed time or the downhole positions, e.g., a determination of the speed of sound and/or whether one or more repeaters is used. The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order.

Figure 9:
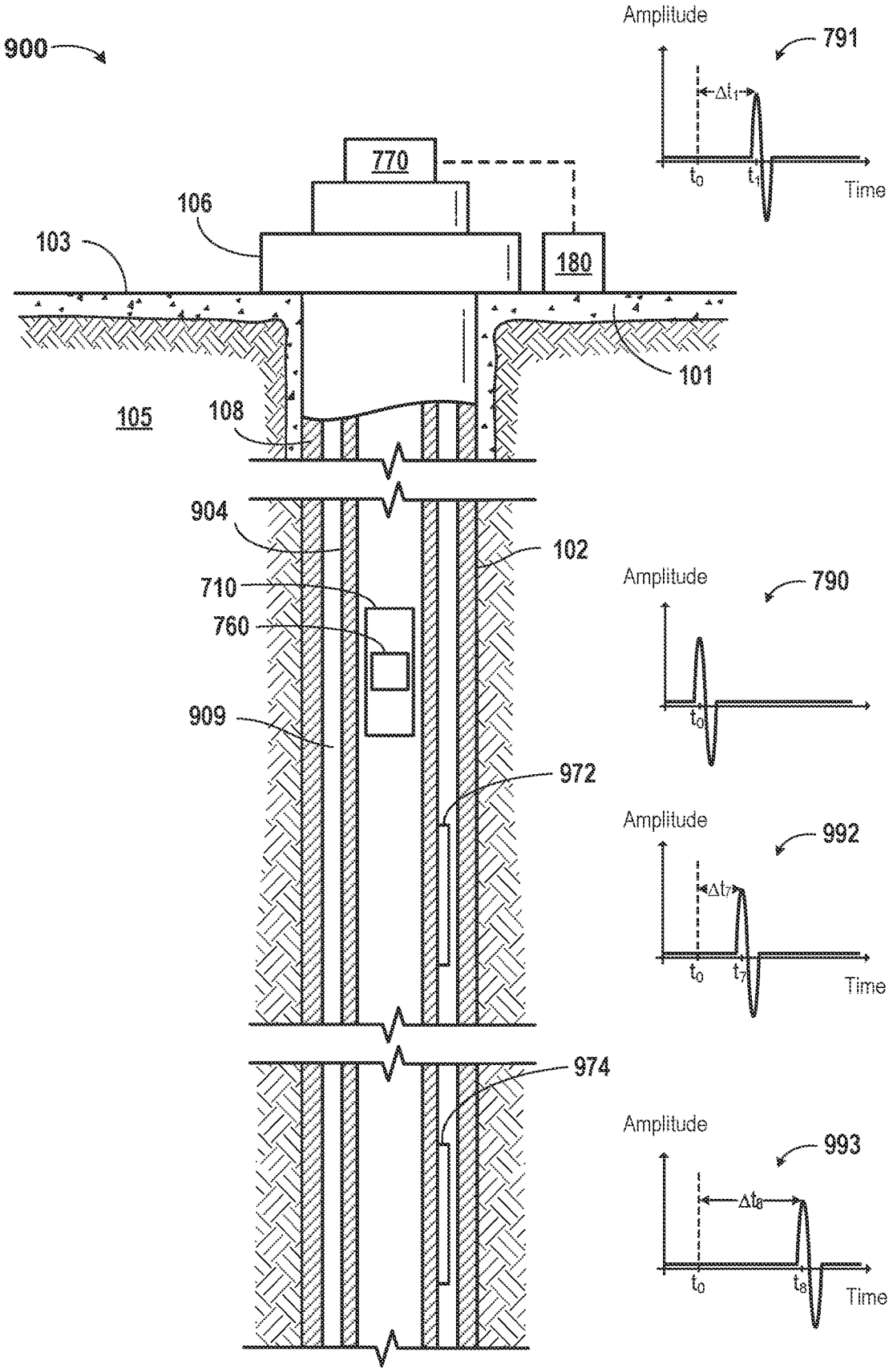
FIG. 9 depicts a partial cross-sectional view of a sixth downhole positioning system, according to one or more embodiments.

FIG. 9 depicts a partial cross-sectional view of a sixth downhole positioning system 900, according to one or more embodiments. The sixth downhole positioning system 900 is similar to the fifth downhole positioning system 700 depicted in FIG. 7 but further includes a tubing string 904 (sometimes called a production string or production tubing) disposed within the casing 108. The tubing string 904 is disposed such that the casing 108 is circumferentially disposed about the tubing string 904 forming an annulus 909 therebetween. The sixth downhole positioning system 900 further includes one or more repeaters (two are shown: a first repeater 972 and a second repeater 974) each at known depths (i.e., at known measured depths along the axis of the wellbore 102). The one or more repeaters can be one or more transceivers. In one or more embodiments, the second transceiver 572 is a repeater. Both the first repeater 972 and the second repeater 974 can be coupled to an outside surface of the tubing string 904, i.e., in the annulus 909. Alternatively, at least one of the first repeater 972 and the second repeater 974 can be included in a separate downhole sub or mandrel (not shown) that is coupled (e.g., via one or more threads or fasteners) to the tubing string 904.

The one or more repeaters can function to receive and retransmit a wireless signal where loss of signal occurs (e.g., due to attenuation, interference, distortion, or the like). As described above, one or more repeaters can be used where the wireless signal is all or mostly transmitted via the tubing (e.g., via tubing string 904). For example, when the first transmitter 760 produces a wireless signal (e.g., the first wireless signal), the one or more repeaters can receive the wireless signal, and optionally retransmit the received wireless signal. The timing of the received signals by the one or more repeaters can be used in the sixth downhole positioning system 900 to further refine the downhole position of the fourth downhole tool 710.

For example, the fourth downhole tool 710 is be disposed at the first downhole position. As described in the second method 800, the first wireless signal is transmitted from the first transmitter 760 along the wellbore 102 at the first time $t_0$, as depicted in the first graph 790, and the first wireless signal is received via the third receiver 770 at the second time $t_1$, as depicted in the second graph 791. In addition to the first wireless signal being received by the third receiver 770, the first wireless signal can also be received by the one or more repeaters. For example, the first repeater 972 can receive the first wireless signal at an eighth time $t_7$, as shown in third graph 992, and the second repeater 974 can receive the first wireless signal at a ninth time $t_8$, as shown in fourth graph 993. The timing of the receipt of the first wireless signal by the third receiver 770, first repeater 972, and the second repeater 974 is dependent on how far each of these is from the fourth downhole tool 710. For example, the first repeater 972 is depicted as being closer to the fourth downhole tool 710 than either the third receiver 770 or the second repeater 974, and thus the eighth time $t_7$ is depicted as being less than the second time $t_1$ or the ninth time $t_8$.

Just as with the third receiver 770, for each of the one or more repeaters, an elapsed time can be determined from the time of transmission of the first wireless signal and receipt thereof by the respective receiver. In one or more embodiments, a seventh elapsed time $\Delta t_7$ between the first time to and the eighth time $t_7$ and an eighth elapsed time $\Delta t_8$ between the first time $t_0$ and the ninth time $t_8$ are determined. For example, both the first repeater 972 and the second repeater 974 can be communicatively coupled to the surface control unit 180 (e.g., via wired connection or wirelessly), the first repeater 972 and the second repeater 974 can communicate the time of receipt to the surface control unit 180, and the machine-readable medium in surface control unit 180 can have program code executable by the processor to determine the seventh elapsed time $\Delta t_7$ and the eighth elapsed time $\Delta t_8$. In one or more embodiments, each of the first repeater 972 and the second repeater 974 can have logic, circuitry, a processor, or the like to determine the elapsed time and then communicate the elapsed time to the surface, e.g., to the surface control unit 180. Based on the seventh elapsed time $\Delta t_7$, the eighth elapsed time $\Delta t_8$, or both, and based on the known depths of the first repeater 972 and the second repeater 974, the first downhole position can be refined and/or updated.

Although the first repeater 972 and the second repeater 974 are discussed as functioning as receivers receiving the first wireless signal from the first transmitter 760, it should be understood that the first repeater 972 and the second repeater 974 could instead function as transmitters and be used with the downhole tool 110 as described in FIG. 5 with regard to the third downhole position system 500. For example, the receiver 150 can receive a transmitted signal from at least one of the first repeater 972 or the second repeater 974 (each at known depths) and determine or refine the downhole position of the downhole tool 110.

Figure 10:
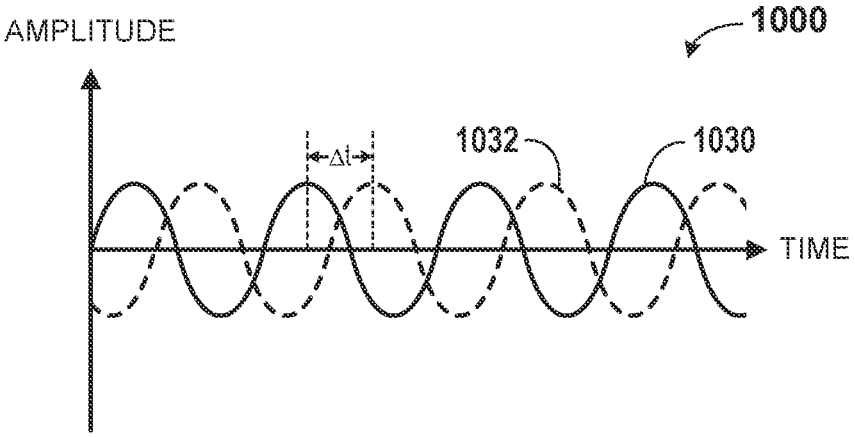
FIG. 10 depicts a graph showing a transmitted wireless signal as a continuous signal, according to one or more embodiments.

FIG. 10 depicts a fifth graph 1000 showing a transmitted signal 1030 as a continuous signal, according to one or more embodiments. In one or more embodiments, the wireless signal transmitted by the first transceiver 170, the second transceiver 572, the first transmitter 760, or one of the repeaters is a continuous signal, e.g., a continuous waveform. For example, as shown, the transmitted signal 1030, e.g., the first wireless signal, is depicted as a continuous sine wave. In one or more embodiments, the continuous signal is transmitted using a siren, e.g., in fluid disposed in the wellbore 102. In one or more embodiments, a continuous resonance or "whistle" can be created as a continuous acoustic signal (e.g., in the tubing, in the fluid, or both).

With a continuous signal being transmitted, the received signal will appear as time shifted continuous signal to the receiver (e.g., receiver 150, first receiver 650, second receiver 652, or third receiver 770). For example, a received signal 1032 can appear as a time shifted signal with respect to the transmitted signal 1030. This time shift, $\Delta t$, between the transmitted signal 1030 and the received signal 1032, e.g., measured peak to peak as shown, can be used just as the elapsed time above to determine the downhole position of the downhole tool (e.g., the downhole tool 110, the third downhole tool 610, or the fourth downhole tool 710). In one or more embodiments, phase shift between the transmitted signal 1030 and the received signal 1032 is used to determine the downhole position of the downhole tool.

In one or more embodiments, the position accuracy, e.g., the determined downhole position, can be refined by passing known locations within the wellbore 102. For example, when the downhole tool (e.g., any of the downhole tools recited above) passes one or more known locations, e.g., one or more magnetic tag, one or more casing collar, etc., the estimation of the speed of sound can be corrected and/or the previously determined downhole position can be updated or refined. In one or more embodiments, the known location is a set-down location of the downhole tool, e.g., if the downhole tool is a service string, and a change in timing between the set-down location and the reverse location can be determined, e.g., one or more methods described above, to verify if the downhole tool is at the proper location, e.g., in a multizone completion operation. For example, the exact location of the reverse location and the downhole position of the tool between the reverse location and the set-down location can be determined with accuracy based using one or more of the methods and systems described above.

Upon determination of a particular downhole position, e.g., the first downhole position or the second downhole position, the downhole tool (e.g., any of the downhole tools recited above) can automatically perform one or more actions, e.g., taking a measurement, setting a tool or valve or plug, setting itself (e.g., a self-setting frac plug), or the like. For example, the downhole tool can be a frac plug with a setting tool that can set itself when it reaches a target location, wherein the target location is the first downhole position or the second downhole position. This can allow plug setting without connection to a conveyance, e.g., without connection to wireline or slickline. In another example, the downhole tool can be a perforating gun, unattached to a conveyance, that can fire when it reaches a target location, wherein the target location is the first downhole position or the second downhole position. In yet another example, the downhole tool can be a sensor that can take one or more measurements or readings and record the downhole position at each measurement or reading and/or take one or more measurements or readings at a specific downhole position or within a window of specific positions. In still another example, the downhole tool can be a service string in the wellbore 102 that can know it has reached the set down location, e.g., a first downhole position, and when it has reached a recirculation position, e.g., a second downhole position. The service string can be disposed into the wellbore 102 via a conveyance, e.g., wireline, slickline, spooled wire, coiled tubing, etc.

The wireless signals above (e.g., the first wireless signal or the second wireless signal) can be one or more acoustic signals or pressure signals. For example, the wireless signal can have a frequency ranging from about 1 megahertz (MHz) to about 1 kilohertz (kHz) to about 0.1 hertz (Hz). A wireless signal around 0.1 Hz can be considered a pressure pulse or a pressure signal.

In one or more embodiments, the wireless signal is an acoustic signal created with mud pulse technology. For example, a positive pulser, a negative pulser, or a siren can be used at the surface of the wellbore 102, e.g., at the wellhead 106, to transmit the acoustic signal. In one or more embodiments, the wireless signal is an acoustic signal created by a hydrophone transmitter, e.g., the first transceiver 170, the second transceiver 572, or the first transmitter 760, can be a hydrophone transmitter using electromagnetic or piezoelectric to create the acoustic signal. In one or more embodiments, the wireless signal is an acoustic signal created by a valve that releases compressed gas into fluid in the wellbore 102.

It will be understood that each block of the flowcharts (e.g., in FIGS. 2 & 8) and other processing disclosed herein can be implemented by program code. The program code may be provided to a processor of a general-purpose computer, special purpose computer, or other programmable machine or apparatus. As will be appreciated, aspects of the disclosure may be embodied as a system, method, or program code (or instructions) stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. A machine-readable storage medium may be any tangible medium that can contain or store a program for use by or in connection with an instruction execution system, apparatus, or device. A machine-readable storage medium is not a machine-readable signal medium. A machine-readable signal medium may include a propagated data signal with machine-readable program code embodied therein, for example, in baseband or as part of a carrier wave. Such a propagated signal may take any of a variety of forms, including, but not limited to, electro-magnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, radio frequency (RF), etc., or any suitable combination of the foregoing. Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and procedural programming languages, such as the "C" programming language or similar programming languages. The program code may execute entirely on a stand-alone machine, may execute in a distributed manner across multiple machines, and may execute on one machine while providing results and or accepting input on another machine. The program code/instructions may also be stored in a machine-readable medium that can direct a machine to function in a particular manner, such that the instructions stored in the machine-readable medium produce an article of manufacture including instructions which implement the function/act specified in a flowchart and/or block diagram block or blocks.

Figure 11:
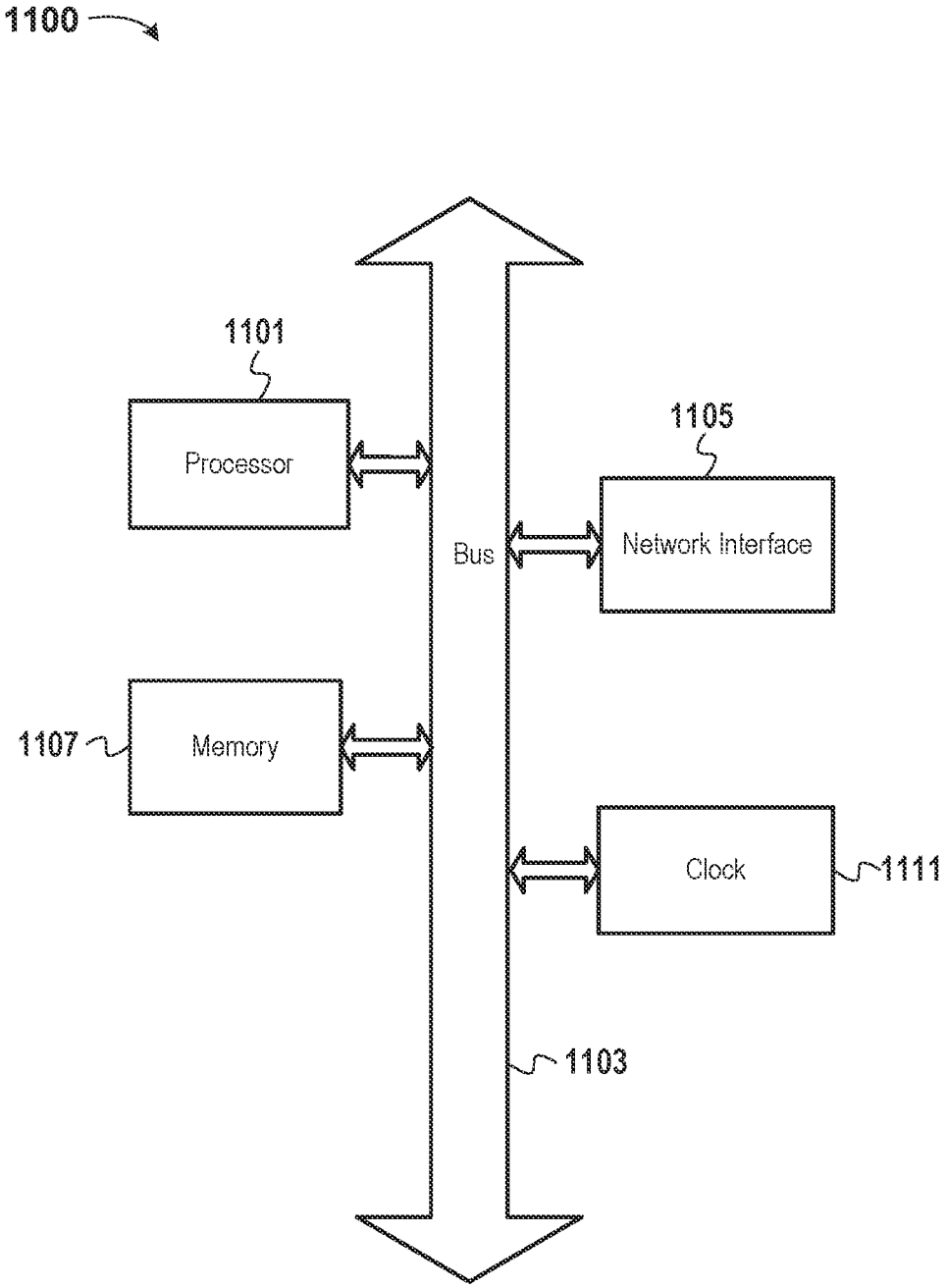
FIG. 11 depicts an example computer system, according to one or more embodiments.

FIG. 11 depicts an example computer system 1100, according to one or more embodiments. The computer system 1100 can be included in or be a component of the surface control unit 180, the downhole tool 110, the second downhole tool 410, the third downhole tool 610, and/or the third receiver 770. The computer system 1100 includes a processor 1101 (possibly including multiple processors, multiple cores, multiple nodes, and/or implementing multithreading, etc.). As noted above, the processor can be included in or be a component of the surface control unit 180, the downhole tool 110, the second downhole tool 410, the third downhole tool 610, and/or the third receiver 770, for example executing one or more machine-readable instructions stored as program code. The computer system 1100 also includes memory 1107. The memory 1107 may be system memory or any one or more of the above already described possible realizations of machine-readable media. In addition, the computer system 1100 includes a bus 1103 and a network interface 1105. The computer system 1100 communicates via transmissions to and/or from remote devices via the network interface 1105 in accordance with a network protocol corresponding to the type of network interface, whether wired or wireless and depending upon the carrying medium. In addition, a communication or transmission can involve other layers of a communication protocol and or communication protocol suites (e.g., transmission control protocol, Internet Protocol, user datagram protocol, virtual private network protocols, etc.). The system also includes a clock 1111. The clock 1111 can be at least one of the first clock and second clock described above. Any one of the previously described functionalities may be partially (or entirely) implemented in hardware and/or on the processor 1101. For example, the functionality may be implemented with an application specific integrated circuit, in logic implemented in the processor 1101, in a co-processor on a peripheral device or card, etc. Further, realizations may include fewer or additional components not illustrated in FIG. 11 (e.g., video cards, audio cards, additional network interfaces, peripheral devices, etc.). The processor 1101 and the network interface 1105 are coupled to the bus 1103. Although illustrated as being coupled to the bus 1103, the memory 1107 may be coupled to the processor 1101.

While the aspects of the disclosure are described with reference to various implementations and exploitations, it will be understood that these aspects are illustrative and that the scope of the claims is not limited to them. In general, techniques for syncing the clocks and determining elapsed time, as described herein, may be implemented with facilities consistent with any hardware system or hardware systems. Many variations, modifications, additions, and improvements are possible. Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Terminology

Unless otherwise specified, use of the terms "connect," "engage," "couple," "attach," or any other like term describing an interaction between elements is not meant to limit the interaction to direct interaction between the elements and may also include indirect interaction between the elements described. For example, antennas may be coupled inductively without touching one another. Unless otherwise specified, use of the terms "up," "upper," "upward," "up-hole," "upstream," or other like terms shall be construed as generally from the formation toward the surface, e.g., toward wellhead 106 in FIG. 1, or toward the surface of a body of water; likewise, use of "down," "lower," "downward," "downhole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE EMBODIMENTS

Numerous examples are provided herein to enhance understanding of the present disclosure. A specific set of example embodiments are provided as follows:

Example A

A method comprising: synchronizing a first clock with a second clock, wherein the first clock is disposed in a first transmitter, wherein the first transmitter is disposed at a known location, and wherein the second clock is disposed in a downhole tool; disposing the downhole tool into a wellbore, wherein the downhole tool comprises a first receiver; transmitting a first wireless signal from the first transmitter along the wellbore at first time; receiving the first wireless signal via the first receiver at a second time; determining a first elapsed time between the first time and the second time; and determining a first downhole position of the downhole tool based on the first elapsed time.

The method of Example A can further include at least one of: (1) estimating a speed of sound in a fluid to provide an estimated speed of sound, wherein the wellbore is filled with the fluid, wherein the downhole tool is disposed in the fluid, and wherein the first downhole position is determined based on the estimated speed of sound, optionally including (A) measuring a pressure in the wellbore with a pressure sensor to provide a measured pressure, wherein the pressure sensor is disposed in the downhole tool; or measuring a temperature in the wellbore with a temperature sensor to provide a measured temperature, wherein the temperature sensor is disposed in the downhole tool, and wherein the estimated speed of sound is based on at least one of the measured pressure or the measured temperature; or (B) determining a pressure in the wellbore is based on a pressure profile along the wellbore to provide a determined pressure; and determining a temperature in the wellbore based on a temperature profile along the wellbore to provide a determined temperature, wherein the estimated speed of sound is based on at least one of the determined pressure or determined temperature; (2) receiving a secondary signal via the downhole tool at a third time, wherein the secondary signal is a reflection of the first wireless signal off of a wellbore bottom, a downhole tubular, or another downhole object; determining a second elapsed time based on a difference between the third time and the first time; and refining the first downhole position of the downhole tool based on the second elapsed time; (3) transmitting a second wireless signal from a second transmitter along the wellbore at the first time; receiving the second wireless signal via the downhole tool at a fourth time; determining a third elapsed time based on a difference between the first time and the fourth time; and refining the first downhole position of the downhole tool based on the third elapsed time; (4) transmitting a second wireless signal along the wellbore from a second transmitter at a fifth time; receiving the second wireless signal via the downhole tool at a sixth time; determining a fourth elapsed time based on a difference between the fifth time and the sixth time; and refining the first downhole position of the downhole tool based on the fourth elapsed time.

In one or more embodiments of Example A, the downhole tool further includes at least on a second receiver, and the second receiver is disposed farther from the first transmitter than the first receiver, the method of Example A further including: receiving the first wireless signal via the second receiver at a seventh time; and determining a time delay between the second time and the seventh time, wherein the estimated speed of sound is based on the time delay. In one or more embodiments of Example A, disposing the downhole tool into the wellbore comprises pumping the downhole tool to the first downhole position. In one or more embodiments of Example A, the first wireless signal is transmitted through a fluid, a downhole tubular, or both; and/or the first wireless signal is one of an acoustic signal, a ping, or a continuous wave, and, optionally, wherein the receiving of the first wireless signal produces a received signal, the method further includes determining a phase shift between the first wireless signal and the received signal.

Example B

A system comprising: a first transceiver having a first clock; and a downhole tool disposed in a wellbore, the downhole tool comprising a second clock, a machine-readable medium, and a processor, wherein the first clock is synchronized with the second clock, and wherein the machine-readable medium has program code executable by the processor to cause the downhole tool to receive at a second time, via the downhole tool or the first transceiver, a first wireless signal transmitted at a first time, determine a first elapsed time between the first time and the second time, and determine a downhole position of the downhole tool based on the first elapsed time.

In one or more embodiments of Example B, the wellbore is filled with a fluid, the downhole tool is disposed in the fluid, wherein the machine-readable medium further comprises program code to estimate a speed of sound in the fluid to provide an estimated speed of sound, and wherein the downhole position is determined based on the estimated speed of sound. Optionally, in one or more embodiments of Example B, the downhole tool comprises at least one of a pressure sensor or a temperature sensor, and wherein the estimated speed of sound is based on at least one of a pressure measured by the pressure sensor or a temperature measured by the temperature sensor.

The system of Example B can further include a second transceiver disposed at a known location, wherein the machine-readable medium further comprises program code to: receive at a third time, via the downhole tool, a second wireless signal transmitted by the second transceiver, determine a second elapsed time between the first time and the third time, and refine the downhole position of the downhole tool based on the second elapsed time.

Example C

A method comprising: synchronizing a first clock with a second clock, wherein the first clock is disposed in a downhole tool, wherein the second clock is disposed in a first receiver, and wherein the first receiver is disposed at a known location; disposing the downhole tool into a wellbore at a first location; transmitting a first wireless signal along the wellbore from the downhole tool at a first time; receiving the first wireless signal via the first receiver at a second time; determining a first elapsed time between the first time and the second time; and determining a first downhole position of the downhole tool based on the first elapsed time.

The method of Example C can further comprise receiving the first wireless signal via a second receiver at a third time, wherein the second receiver is disposed in the wellbore; determining a second elapsed time between the first time and the third time; and refining the first downhole position of the downhole tool based on the second elapsed time.

The invention claimed is:

1. A method comprising:

synchronizing a first clock with a second clock, wherein the first clock is disposed in a first transmitter, wherein the first transmitter is disposed at a known location, and wherein the second clock is disposed in a downhole tool;

disposing the downhole tool into a wellbore, wherein the downhole tool comprises a first receiver;

transmitting a first wireless signal from the first transmitter along the wellbore at first time, wherein the first wireless signal is a continuous wave;

receiving the first wireless signal via the first receiver at a second time, wherein the receiving of the first wireless signal produces a received signal;

determining a phase shift between the first wireless signal and the received signal; and determining a first downhole position of the downhole tool based on the phase shift.

2. The method of claim 1, further comprising estimating a speed of sound in a fluid to provide an estimated speed of sound, wherein the wellbore is filled with the fluid, wherein the downhole tool is disposed in the fluid, and wherein the first downhole position is refined based on the estimated speed of sound.

3. The method of claim 2, further comprising at least one of:

measuring a pressure in the wellbore with a pressure sensor to provide a measured pressure, wherein the pressure sensor is disposed in the downhole tool; or measuring a temperature in the wellbore with a temperature sensor to provide a measured temperature, wherein the temperature sensor is disposed in the downhole tool, and wherein the estimated speed of sound is based on at least one of the measured pressure or the measured temperature.

4. The method of claim 2, further comprising:

determining a pressure in the wellbore is based on a pressure profile along the wellbore to provide a determined pressure; and determining a temperature in the wellbore based on a temperature profile along the wellbore to provide a determined temperature, wherein the estimated speed of sound is based on at least one of the determined pressure or determined temperature.

5. The method of claim 2, wherein the downhole tool further comprises a second receiver, and wherein the second receiver is disposed farther from the first transmitter than the first receiver, the method further comprising:

receiving the first wireless signal via the second receiver at a seventh time; and determining a time delay between the second time and the seventh time, wherein the estimated speed of sound is based on the time delay.

6. The method of claim 1, wherein disposing the downhole tool into the wellbore comprises pumping the downhole tool to the first downhole position.

7. The method of claim 1, further comprising:

receiving a secondary signal via the downhole tool at a third time, wherein the secondary signal is a reflection of the first wireless signal off of a wellbore bottom, a downhole tubular, or another downhole object;

determining an elapsed time based on a difference between the third time and the first time; and refining the first downhole position of the downhole tool based on the second elapsed time.

8. The method of claim 1, further comprising:

transmitting a second wireless signal from a second transmitter along the wellbore at the first time;

receiving the second wireless signal via the downhole tool at a fourth time;

determining an elapsed time based on a difference between the first time and the fourth time; and refining the first downhole position of the downhole tool based on the elapsed time.

9. The method of claim 1, further comprising:

transmitting a second wireless signal along the wellbore from a second transmitter at a fifth time;

receiving the second wireless signal via the downhole tool at a sixth time;

determining an elapsed time based on a difference between the fifth time and the sixth time; and refining the first downhole position of the downhole tool based on the fourth elapsed time.

10. The method of claim 1, wherein the first wireless signal is transmitted through a fluid, a downhole tubular, or both.

11. The method of claim 1, wherein the first wireless signal is an acoustic signal.

12. The method of claim 1, wherein the first wireless signal comprises a sine wave.

13. The method of claim 1, wherein upon determining the first downhole position of the downhole tool based on the phase shift, the method further comprises automatically performing one or more actions performed by the downhole tool within the wellbore.

14. A system comprising:

a first transceiver having a first clock; and a downhole tool disposed in a wellbore, the downhole tool comprising a second clock, a non-transitory machine-readable medium, and a processor, wherein the first clock is synchronized with the second clock, and wherein the non-transitory machine-readable medium has program code executable by the processor to cause the downhole tool to:

receive at a second time, via the downhole tool or the first transceiver, a first wireless signal transmitted at a first time, wherein the first wireless signal is a continuous wave and wherein receiving the first wireless signal produces a received signal;

determine a phase shift between the first wireless signal and the received signal; and determine a downhole position of the downhole tool based on the phase shift.

15. The system of claim 14, wherein the wellbore is filled with a fluid, wherein the downhole tool is disposed in the fluid, wherein the non-transitory machine-readable medium further comprises program code to estimate a speed of sound in the fluid to provide an estimated speed of sound, and refine the determined downhole position based on the estimated speed of sound.

16. The system of claim 15, wherein the downhole tool comprises at least one of a pressure sensor or a temperature sensor, and wherein the estimated speed of sound is based on at least one of a pressure measured by the pressure sensor, or a temperature measured by the temperature sensor.

17. The system of claim 14, further comprising a second transceiver disposed at a known location, wherein the non-transitory machine-readable medium further comprises program code to:

receive at a third time, via the downhole tool, a second wireless signal transmitted by the second transceiver, determine an elapsed time between the first time and the third time, and refine the downhole position of the downhole tool based on the elapsed time.

18. The system of claim 14, wherein upon determining the downhole position of the downhole tool based on the phase shift, the downhole tool is further configured to automatically perform one or more actions downhole within the wellbore.

19. A method comprising:

synchronizing a first clock with a second clock, wherein the first clock is disposed in a downhole tool, wherein the second clock is disposed in a first receiver, and wherein the first receiver is disposed at a known location;

disposing the downhole tool into a wellbore at a first location;

transmitting a first wireless signal along the wellbore from the downhole tool at a first time, wherein the first wireless signal is a continuous wave;

receiving the first wireless signal via the first receiver at a second time, wherein the receiving of the first wireless signal produces a received signal;

determining a phase shift between the first wireless signal and the received signal; and determining a first downhole position of the downhole tool based on the phase shift.

20. The method of claim 19, further comprising:

receiving the first wireless signal via a second receiver at a third time, wherein the second receiver is disposed in the wellbore;

determining an elapsed time between the first time and the third time; and refining the first downhole position of the downhole tool based on the elapsed time.

* * * * *